US006659663B1

(12) United States Patent
Shirotori et al.

(10) Patent No.: US 6,659,663 B1
(45) Date of Patent: Dec. 9, 2003

(54) HEAD DRIVE CIRCUIT FOR IMPACT DOT PRINTER

(75) Inventors: Hiroshi Shirotori, Nagano (JP); Hisashi Watamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/693,991

(22) Filed: Oct. 23, 2000

(30) Foreign Application Priority Data

Oct. 22, 1999 (JP) ..... 11-301775
Apr. 24, 2000 (JP) ..... 2000-122554
Apr. 24, 2000 (JP) ..... 2000-123099

(51) Int. Cl.[7] ..... B41J 2/30
(52) U.S. Cl. ..... 400/124.01; 400/124.03
(58) Field of Search ..... 400/124.01, 124.03, 400/124.05, 124.11, 124.18, 124.17, 124.14, 124.13, 157.2, 157.3, 118.3, 124.16

(56) References Cited

U.S. PATENT DOCUMENTS

| | | | | |
|---|---|---|---|---|
| 4,454,558 A | | 6/1984 | Huddart | 361/153 |
| 4,637,742 A | | 1/1987 | Sakai | 400/121 |
| 4,850,724 A | * | 7/1989 | Fattori | 400/157.2 |
| 5,190,383 A | * | 3/1993 | Suzuki et al. | 400/124.16 |
| 5,325,228 A | * | 6/1994 | Matsubara et al. | 359/249 |

FOREIGN PATENT DOCUMENTS

| | | | | |
|---|---|---|---|---|
| EP | 0 373 870 A2 | | 6/1990 | |
| EP | 0 472 407 A1 | | 2/1992 | |
| EP | 1089419 A2 | * | 4/2001 | H02M/3/155 |
| GB | 2103443 | * | 2/1983 | 400/157.2 |
| JP | 0036468 | * | 3/1983 | 400/157.2 |
| JP | 58-219070 A | | 12/1983 | |
| JP | 3-51140 | | 3/1991 | B41J/2/30 |

* cited by examiner

*Primary Examiner*—Andrew H. Hirshfeld
*Assistant Examiner*—Anthony H. Nguyen
(74) *Attorney, Agent, or Firm*—Sughrue Mion, PLLC

(57) ABSTRACT

For a print head in an impact dot printer, a drive transistor 33 is connected in series to a head coil 59 that drives a print wire, and a pulse 32 is used to turn the drive transistor 33 on and off. Thus, the drive current i is supplied to the head coil 59 to drive the print wire. The input end of a DC/DC converter 2 is connected to the juncture of the head coil 59 and the drive transistor 33, and the output end of the DC/DC converter 2 is connected to the juncture of a power source 34 and the head coil 59. The DC/DC converter 2 clamps, at a constant level, e.g., 90V, the inductive electromotive force of a high voltage that is generated by the head coil 59 when the drive transistor 33 is rendered off. Then, the DC/DC converter 2 transforms the clamped voltage to a voltage equivalent to the voltage level of the power source 34, e.g., 35V. As a result, instead of energy being wasted by the transistor 33, the energy accumulated by the head coil 59 is returned to the power source 34 and can again be employed, while the input voltage of the DC/DC converter 2 is maintained at a constant level by an initial charger 4.

12 Claims, 7 Drawing Sheets

FIG. 5A
FIG. 5B
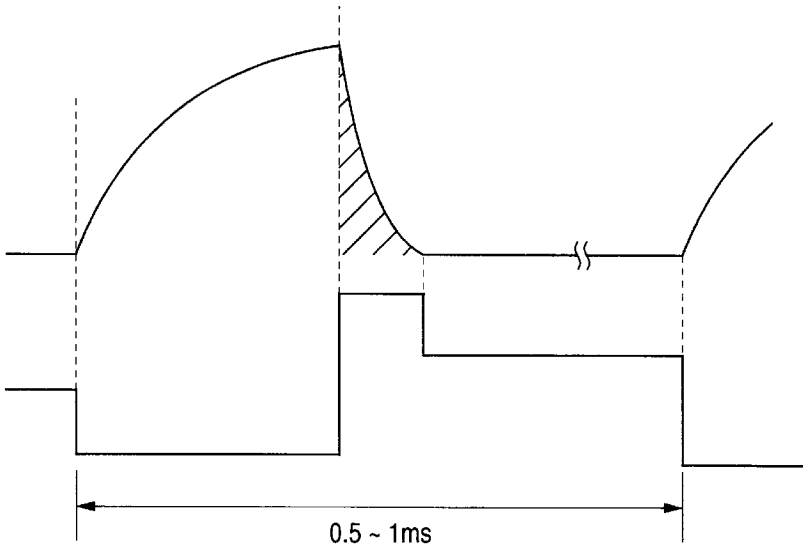
FIG. 5C
FIG. 5D
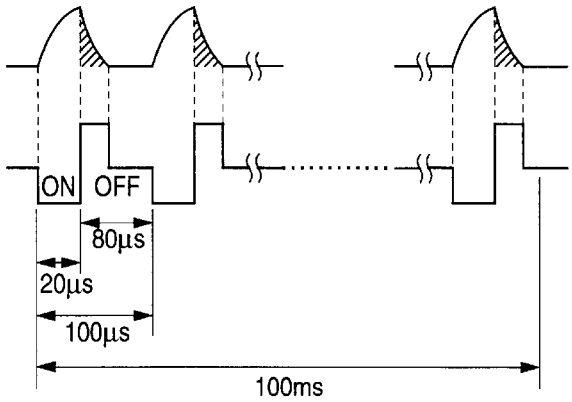

HEAD DRIVE CIRCUIT FOR IMPACT DOT PRINTER

BACKGROUND OF THE INVENTION

The present invention relates to an impact dot printer, and more specifically, relates to a circuit for driving a head of an impact dot printer and to a power control technique for controlling a power source for a head drive circuit.

To perform printing, an impact dot printer drives a print wire by using, for example, the magnetic attractive force of an electromagnet. FIG. 8 is a diagram showing an example wire impact print head for the print head of the thus arranged impact dot printer.

In the example in FIG. 8, a wire impact print head 51 has a plurality of wires 57 that are attached, by wire levers 53 and return springs 55, so that they reciprocate. When a drive current flows through a head coil 59, a wire lever 53 is attracted by the magnetic attractive force produced by the electromagnet in the direction indicated by an arrow in FIG. 8, and a wire 57 strikes an ink ribbon 61 and forms dots on a printing sheet 65 moved in consonance with the rotation of a platen 63.

FIG. 9 is a diagram illustrating the fundamental structure of the circuit of the print head 51 for driving the head coil 59. In this example, only one head coil 59 and head drive transistor 33 set is shown, but in actuality, a plurality of these sets are provided. A drive circuit (driver) 30 for each head coil 59 is constituted by one of the head drive transistors 33, a head drive power source 34 and a Zener diode 35. During a predetermined conductive period, a control pulse 32 is maintained at level H by a print controller 31, and a pertinent head drive transistor 33 is maintained in the ON state (in the saturated region). Then, a voltage (e.g., 35V) supplied by the head drive power source 34 is applied to the head coil 59, and a drive current i1 flows through it. Thereafter, when the control pulse 32 falls to level L, the head coil 59 generates an inductive electromotive force to render off the head drive transistor 33. For this, the Zener diode 35 is rendered conductive at the induced voltage, and a base current flows to the head drive transistor 33, while the head drive transistor 33 enters a linear operating region. Subsequently, the drive current i1 flows through the head drive transistor 33 and the current value is drastically reduced, and as a result, the head drive transistor 33 is rendered off.

However, in the related head drive circuit, when the head drive transistor is turned off, the power supplied by the head drive power source is not effectively employed. This problem will be described while referring to FIGS. 10A to 10D. In these drawings are presented a diagram showing a simplified head drive circuit, and other diagrams showing the flow of the drive current, as well as its current waveform and the operation of the Zener diode.

First, as is shown in FIG. 10A, when the transistor is rendered on, a drive current i is supplied by a power source Vp in the direction indicated by the arrow, and a head coil is driven. At this time, the collector-emitter voltage (VCE) of the transistor is substantially zero.

To render off the transistor, when the inductive electromotive force that is generated at the coil at the polarities shown in FIG. 10A exceeds the Zener voltage, the Zener diode is rendered conductive, and a base current flows via the Zener diode to the transistor, as is indicated by a broken line in FIG. 10A. Then, the charge on the transistor falls in the linear operation mode, and the energy accumulated in the coil is discharged through the collector and the emitter of the transistor. When the discharge of the energy has been completed, the Zener diode is again rendered non-conductive and the transistor is rendered off.

FIGS. 10B and 10C are graphs showing the changes produced by this process in the collector current i and the collector-emitter voltage (VCE) of the transistor as time elapses. As a result, as is shown in FIG. 10D, of the power (see FIG. 10B) supplied by the power source, power P ($=i \cdot V_{CE}$), which is required to render off the transistor, is consumed for heat generation at the transistor as thermal loss represented by Q in the figure.

As is described above, in the related head drive circuit, the power supplied by the power source to render off the transistor is lost and is not effectively employed. Furthermore, since a great deal of heat is generated by the transistor, a cooling member, such as a heat sink, is also required, and accordingly, the size of the package of a power source is enlarged.

SUMMARY OF THE INVENTION

To resolve these shortcomings, it is one objective of the present invention to provide a head drive circuit that not only drives the head efficiently, but also reduces the consumption of power, and to produce a compact power source.

To achieve the above objective, according to the present invention, there is provided a head drive circuit for an impact dot printer which performs printing by driving a print wire, comprising:

- a DC power source for supplying a power source voltage;
- a head coil;
- a switching element which is on/off controlled to apply the power source voltage to the head coil for a predetermined time period;
- a voltage regulator for converting an input voltage having a value higher than the power source voltage into an output voltage having a value as substantially same as the power source voltage;
- a voltage introducer for inputting an inductive voltage, generated in the head coil when the switching element is turned off, into the voltage regulator as the input voltage; and
- a voltage returner for feeding back the output voltage of the voltage regulator to the DC power source.

Namely, the head drive circuit is so configured that the voltage regulator returns to the power source the power that accumulates when the switching element (e.g., a transistor) is rendered off.

With this arrangement, the energy that accumulates in the head coil when the switching element is turned off is returned to the power source by the voltage regulator, and is effectively utilized for driving the head coil.

A DC/DC converter or a voltage dropper may be adopted as the voltage regulator.

Preferably, the voltage introducer includes a first rectifier which is rendered conductive when the inductive voltage is generated in the head coil to unidirectionally supply the inductive voltage into the voltage regulator as the input voltage, and the voltage returner includes a second rectifier for unidirectionally supplying the output voltage from the voltage regulator to the DC power source. For example, diodes may be adopted as the rectifiers.

Since the rectifiers (e.g., diodes) required for the prevention of a crosscurrent are provided, the backflow of power, from the input end of the voltage regulator to the switching element, or the inverted supply of power, from the power source to the output end of the voltage regulator, can be prevented.

Preferably, the head drive circuit further comprises an input voltage adjuster for adjusting the input voltage of the voltage regulator so as to have a predetermined value higher than the power source voltage. Specifically, so long as the input voltage of the voltage regulator is raised to a predetermined voltage that only when the switching element is rendered off is higher than the voltage provided by the power source, the power from the head coil can be led to the voltage regulator and can thereafter be returned to the power source by a high induction voltage that is generated at the head coil.

Preferably, the voltage regulator includes an input condenser for smoothing the input voltage thereof. The voltage adjuster includes a charger for charging the input condenser so as to have the predetermined value of input voltage before and while the printing is performed.

Preferably, the charger always applies the predetermined value of voltage to the input condenser.

Alternatively, the switching element is turned on/off repeatedly at a frequency too high to drive the print wire to apply the inductive voltage to the input condenser repeatedly at least before the printing is performed, thereby the switching element and the head coil serve as the charger.

Alternatively, the charging operation using the switching element and the head coil may be used not only for the initial charging performed before the printing is started, but may also be used, as needed, during the printing operation (e.g., following a line return) to supplement the discharging of the condenser.

Alternatively, the charger includes: a charge coil; a coil switching element which is on/off controlled to apply the power source voltage to the charge coil; and an input voltage holder for inputting an inductive voltage, generated in the charge coil when the coil switching element is turned off, to the input condenser. The coil switching element is turned on/off repeatedly to apply the inductive voltage generated in the charge coil to the input condenser repeatedly at least while the printing is performed, thereby the charged voltage in the input condenser is maintained at the predetermined value.

Alternatively, the input voltage holder may be employed not only for supplementary charging during the printing, but also for the initial charging performed before printing is begun.

BRIEF DESCRIPTION OF THE DRAWINGS

In the accompanying drawings:

FIG. 3B being a waveform graph for a drive current that flows through a head coil; FIG. 3C being a waveform graph for the collector-emitter voltage of a head drive transistor; and FIG. 3D being a graph showing power loss of the head drive transistor;

FIGS. 5A to 5D are waveform graphs for the printing and for the initial charging according to the second embodiment, with FIG. 5A showing the waveform of a current that flows through a head coil during printing; FIG. 5B showing the waveform of the collector-emitter voltage of a head drive transistor during printing; FIG. 5C showing the waveform of a charge current that flows through the head coil during the initial charging; and FIG. 5D showing the waveform of the collector-emitter voltage of the head drive transistor during the initial charging;

FIG. 10B being a waveform graph for a drive current that flows through a head coil; FIG. 10C being a waveform graph for the base-emitter voltage of a head drive transistor; and FIG. 10D being a graph showing the power loss for the head drive transistor.

DETAILED DESCRIPTION OF THE PREFERRED EMBODIMENTS

Figure 1:
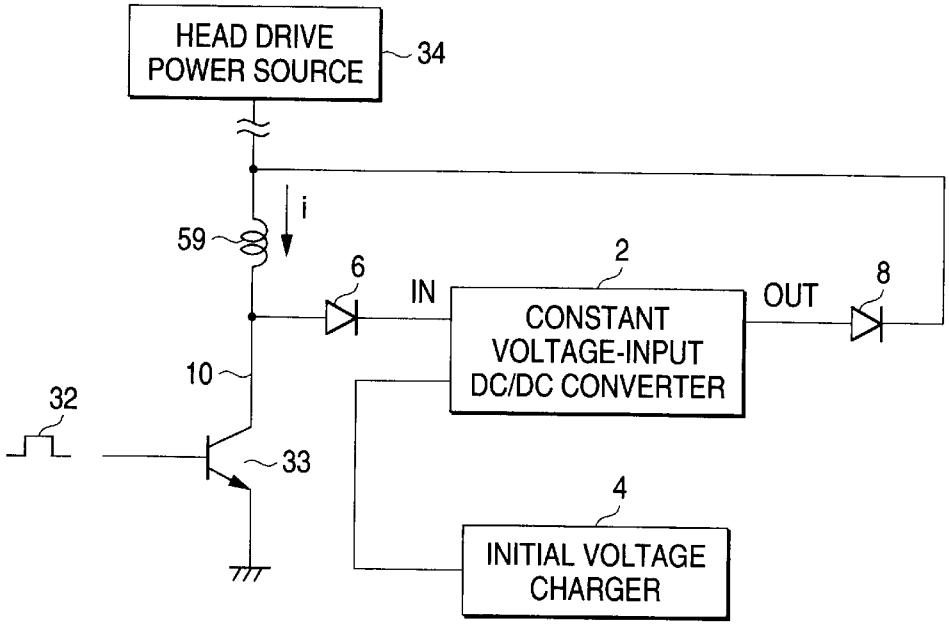
FIG. 1 is a diagram showing the arrangement of a head drive circuit according to a first embodiment of the invention.

The preferred embodiments of the present invention will now be described while referring to the accompanying drawings. FIG. 1 is a diagram showing the arrangement of a head drive circuit according to a first embodiment of the present invention.

As is shown in FIG. 1, the head drive circuit comprises: a head drive transistor 33, for driving a head coil 59; a constant voltage-input DC/DC converter 2, which has an input voltage of 90V and an output voltage of 35V that is equivalent to that of a head drive power source 34; an initial voltage charger 4, for raising the voltage input by the constant voltage-input DC/DC converter 2 to 90V; a diode 6 (a first rectifier) the anode of which is connected to the head coil 59 and a collector 10 of the head drive transistor 33 and the cathode of which is connected to the input end of the constant voltage-input DC/DC converter 2; and a diode 8 (a second rectifier) the anode of which is connected to the output end of the constant input DC/DC converter 2 and the cathode of which is connected to the head drive power source 34. A related Zener diode, which connects the head coil 59 and the base of the head drive transistor 33, is not provided for the head drive circuit of this embodiment. And the operation of the constant voltage-input DC/DC converter 2 is so controlled that the input voltage is 90V and the output voltage is equal to a voltage, such as 35V, obtained by adding the voltage drop at the diode 8 of the head drive power source 34.

Before a print head actually begins printing, the initial voltage charger 4 sets a voltage of 90V as the input voltage for the constant voltage-input DC/DC converter 2 (the charge voltage for a smoothing condenser 2*a* in FIG. 2, which will be described later, that is provided at the input end of the DC/DC converter 2). When the head drive transistor 33 is rendered on, a drive current supplied by the head drive power source 34 drives the head coil 59. When the head drive transistor 33 is rendered off, an induced electromotive force is generated at the head coil 59, so that a high voltage is produced at the collector 10 of the head drive transistor 33 and is clamped at the 90V input voltage of the DC/DC converter 2. The drive current i is absorbed by the constant voltage-input DC/DC converter 2, is returned, via the diode 8, from the output end of the DC/DC converter 2 to the head drive power source 34, and is employed again.

Figure 2:
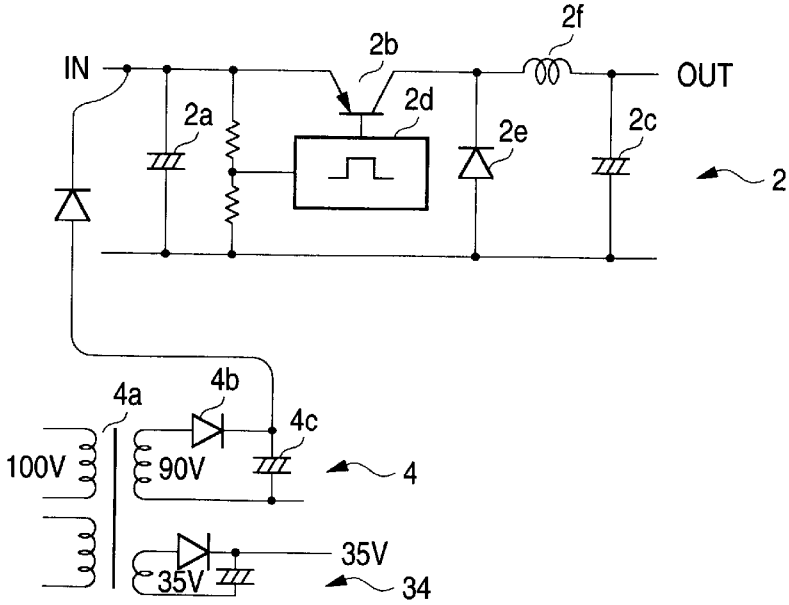
FIG. 2 is a circuit diagram showing a constant voltage-input DC/DC converter and an initial voltage charger according to the first embodiment.

FIG. 2 is a circuit diagram showing the constant voltage-input DC/DC converter 2 and the initial voltage charger 4. The constant voltage-input DC/DC converter 2 employs a drive controller 2*d* to switch a chopper transistor 2*b* in order to control a duty ratio. Therefore, the 90V input voltage of the DC/DC converter 2 is chopped, and on the output side, the obtained voltage waveform is smoothed and reduced by a condenser 2*c* to provide a constant 35V output, while a feedback diode 2*e* feeds the energy accumulated at a DC reactor 2f back to the condenser 2*c* when the transistor 2*b* is rendered off. In the initial voltage charger 4, a transformer 4*a* reduces an AC voltage of 100V, received from a commercially available power source, to an AC voltage of 90V. The AC voltage of 90V is rectified by a diode 4*b*, and the obtained voltage is smoothed by a condenser 4c to provide a DC voltage of 90V that is applied to the input end of the constant voltage-input DC/DC converter 2. As a result, a constant voltage-input of 90V is maintained for the input voltage DC/DC converter 2.

In addition to the chopper system in FIG. 2 that uses a constant voltage control amplifier, various other configurations, such as a ringing choke converter, may be employed for the constant input DC/DC converter 2. Furthermore, the initial voltage charger 4 is not limited to the arrangement shown in FIG. 2.

FIGS. 3A to 3D are diagrams showing a simplified circuit for the head drive circuit according to this embodiment, and graphs showing the flow of a drive current and its current waveform. The operation of the head drive circuit of this embodiment will now be explained while referring to FIGS. 3A to 3D.

While, as is indicated by a chained line in FIG. 3A, it is natural for a pair of the head coil 59 and the head drive transistor 33 to be provided for each of multiple print wires, the processing will be explained for the pair of the head coil 59 and the head drive transistor 33 for one print wire. First, when the head drive transistor 33 is rendered on, the drive current i, which is supplied by the power source Vp in the direction indicated by an arrow, and the power P shown in FIG. 3B is supplied to and drives the head coil 59.

Figure 3A:
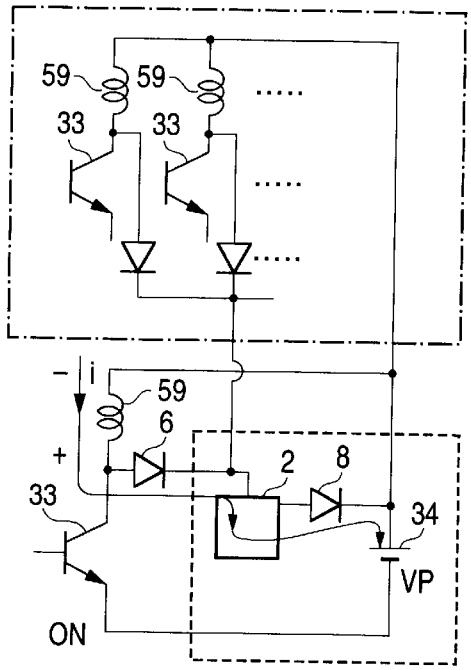
FIGS. 3A to 3D are diagrams for explaining the operation of the head drive circuit according to the first embodiment, with FIG. 3A being a simplified circuit diagram for the head drive circuit.
Figure 3B:
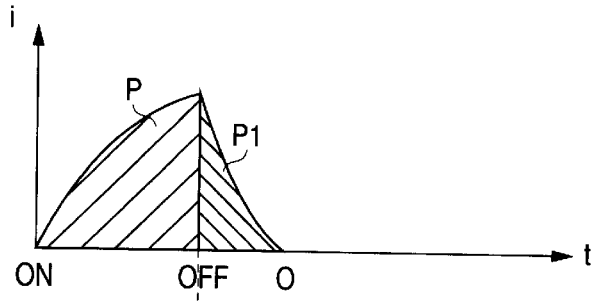
Figure 3C:
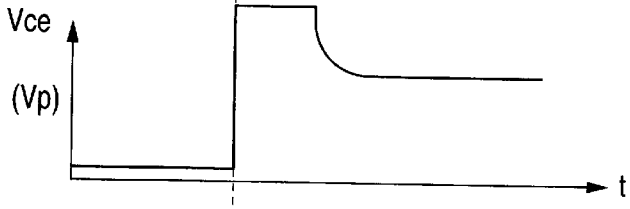
Figure 3D:
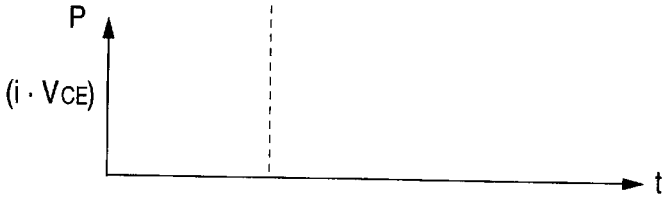

Then, when the head drive transistor 33 is rendered off, an induced electromotive force, having the polarities shown in FIG. 3A, is generated at the head coil 59, and the diode 6 is rendered conductive by the application of the high, induced voltage. Thus, as is shown in FIG. 3C, the collector voltage at the head drive transistor 33 is clamped at the 90V input voltage provided by the DC/DC converter 2, and as is indicated by the arrow in FIG. 3A, the drive current i flows via the diode 6 to the input end of the constant voltage-input DC/DC converter 2. In this manner, the current that is supplied to the head coils 59 of the multiple print wires when they are turned off is absorbed by the input end of the constant voltage-input DC/DC converter 2. The absorbed current is thereafter transformed by the constant voltage-input DC/DC converter 2 to provide a DC current having substantially the same voltage as the voltage Vp provided by the head drive power source 34, and the obtained DC current is transmitted, via the diode 8, from the output end of the DC/DC converter 2 to the head drive power source 34. Therefore, since the head drive transistor 33 can be immediately and completely rendered off, and since the current that flows through the head drive transistor 33 is substantially zero, as is shown in FIG. 3D there is no substantial power loss at the head drive transistor 33. That is, as is indicated by the right-down hatching in FIG. 3B, according to this embodiment, the power P1 that is to be wasted in the related circuit when the head drive transistor 33 is rendered off can be returned to the power source 34 and employed again as head driving energy. The heat generated by the transistor 33 is also reduced considerably, so that only a simple cooling countermeasure is required and the size of a power source package can be reduced.

In this embodiment, the head coil and the drive transistor are constituted at one stage. The arrangement, however, is not limited to this one, and drive transistors may, for example, be provided in both the upper and lower stages and employed for the respective upper and lower head coils. For this circuit structure, the waveform of the drive current would differ from that shown in FIG. 3B; however, also in such a configuration, the energy wasted when the transistor is in the OFF state can be returned to the head drive power source and employed again.

Figure 4:
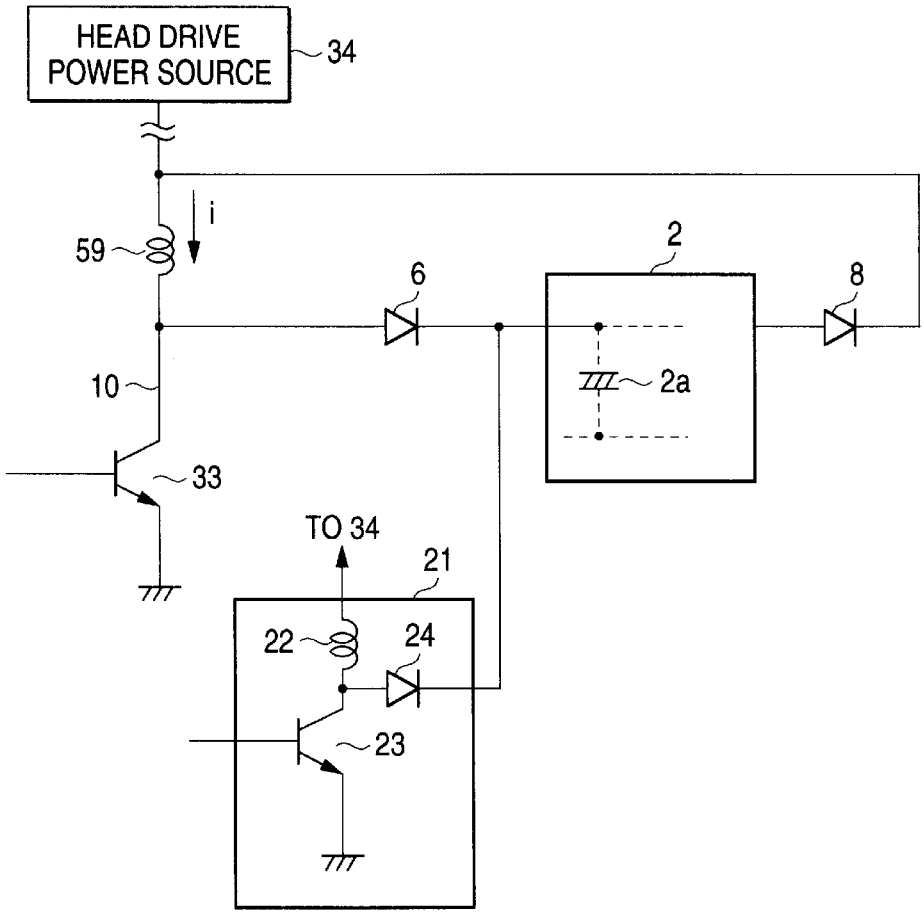
FIG. 4 is a diagram showing the arrangement of a head drive circuit according to a second embodiment of the invention.

A second embodiment of the present invention will now be described while referring to the drawings. FIG. 4 is a diagram showing the arrangement of a head drive circuit according to a second embodiment of the present invention. The head drive circuit differs from the circuit for the first embodiment in FIG. 1, in that the initial voltage charger 4 is replaced with an input voltage holder 21. In the input voltage holder 21, a charge coil 22, a child drive transistor 23 and a diode 24 are connected in the same manner as are a head coil 59, a head drive transistor 33 and a diode 6 that together constitute the print wire drive circuit; however, the current capacity is smaller than that of the print wire drive circuit. Before printing is initiated, the head coil 59 and the head drive transistor 33, which constitute the print wire drive circuit, are repetitiously and rapidly driven at short intervals, so that an initial charge is placed on a condenser 2*a* (hereinafter referred to simply as a condenser 2*a*) on the input side of the constant voltage-input DC/DC converter 2. After printing is begun, the input voltage holder 21 is driven as needed to place supplemental charges on the condenser 2*a*, so that a reduction in the input voltage due to the discharging of the condenser 2*a* can be prevented.

The processing performed for the second embodiment will now be described. However, since the same process as in the first embodiment is performed when the constant voltage-input DC/DC converter 2 absorbs the energy accumulated by the head coil 59 at the time the head drive transistor 22 is rendered off and subsequently returns the energy to the power source 34, no further explanation for this process will be given.

First, when a printer is powered on, before printing is initiated the initial charging is performed, at a predetermined time, for the constant voltage-input DC/DC converter 2. At this time, the print wire in the head is repeatedly and rapidly driven by pulses, emitted by the print wire drive circuit, that are short enough to prevent the print wire from actually being operated. That is, ON/OFF pulses emitted at such a high frequency that they do not drive the print wire are transmitted to the base-emitter of the head drive transistor 33. Thus, the head drive transistor 33 is repetitively and rapidly rendered on and off, while the head coil 59 accumulates from the power source 34 energy that is transmitted to and is used to place a charge on the condenser 2*a* of the DC/DC converter 2. This process is repeated until the condenser 2*a* is charged to 90V. Thereafter, the normal printing operation is begun.

Since the charge voltage on the condenser 2*a* gradually drops during printing, periodically, or as needed, e.g., each time the printing of one line is completed or each time a string of 40 characters has been printed, at the same high pulse as is employed for the initial charging, the input voltage holder 21 is rapidly and repetitiously turned on and off during a specific period. In this manner, supplemental charging of the condenser 2*a* is performed, and the charge voltage held by the condenser 2*a* is maintained substantially at the 90V level.

As is shown in FIG. 4, the input voltage holder 21 includes: the charge coil 22; the coil drive transistor 23, which drives the charge coil 22; and a diode 24, which is rendered conductive by the inductive electromotive force that is generated at the charge coil 22 when the coil drive transistor 23 is turned off and which transmits a current to the input end of the DC/DC converter 2. The supplemental charging process for the input voltage holder 21 is exactly the same as the initial charging process performed for the print wire drive circuit. That is, each time the transistor 23 is rendered on, energy is accumulated by the charging coil 22, and each time the transistor 23 is rendered off, the accumulated energy is transmitted, via the diode 24, to the condenser 2*a*. When this operation is repeated over a predetermined period of time, the voltage held by the condenser 2*a* is supplemented, and is maintained at the 90V level. The charge current used for the supplemental charging may be smaller than the charge current that is required for the initial charging, so that the current capacity of the input voltage holder 21 may be smaller than that of the print wire drive circuit.

The initial charging operation will be described in more detail while referring to a waveform diagram in FIGS. 5A to 5D. FIGS. 5A and 5B are diagrams showing the waveform of the print wire drive circuit during printing. The waveform of the current that flows through the head coil 59 is shown in FIG. 5A, while the waveform of the collector-emitter voltage of the head drive transistor 33 is shown in FIG. 5B. FIGS. 5C and 5D are diagrams showing the waveforms of the print wire drive circuit during the initial charging. The waveform of the initial charge current that flows through the head coil 59 is shown in FIG. 5C, while the waveform of the base-emitter voltage at the head drive transistor 33 is shown in FIG. 5D.

During the printing operation, the head drive transistor 33 is driven by a pulse having a frequency of substantially 1 to 2 kHz, as is shown in FIG. 5B. Then, the current shown in FIG. 5A flows to the head coil 59 and the print wire is driven. For the initial charging, the head drive transistor 33 is repetitively, about 1000 times, rendered on and off, for about 100 ms, using a pulse having a frequency of about 10 kHz, as shown in FIG. 5D (e.g., an ON time width of 20 $\mu$s and an OFF time width of 80 $\mu$s). As a result, a tiny pulse current having the short time width shown in FIG. 5C is repetitively supplied to the head coil 59; however, such a tiny current at such a high frequency does not drive the print wire. Of the tiny current pulses, the current in the portions wherein the head drive transistor 33 has been rendered off (e.g., the current in the shaded portions in FIG. 5C) flows, via the diode 24, as a charge current to the condenser 2*a* of the constant voltage-input DC/DC converter 2. When, through this switching, during a 100 ms period the charge current is repetitively supplied 1000 times, the charge voltage held by the condenser 2*a* is increased until it is substantially 90V.

The supplemental charging, which is performed during the printing process by the input voltage holder 21, can be effected by rendering on and off the coil drive transistor 23 at a pulse having the same frequency as that employed for the initial charging, or at a pulse having a higher frequency. For the supplemental charging, for example, a charge inductance 22 of 3300 $\mu$H is employed to drive the coil drive transistor 23 following each line return at a pulse having a frequency of 25 kHz and an ON time of 3 $\mu$s.

As is described above, since the input voltage holder 21 only performs supplemental charging, its current capacity is smaller than that of the wire drive circuit. As a modification, the current capacity of the input voltage holder 21 may be increased to that of the print wire drive circuit, so that the input voltage holder 21 can also perform the pre-printing initial charging. Or instead, the printing wire drive circuit and the input voltage holder 21 may together be employed to perform the initial charging.

As another modification, the supplemental charging may be performed by the print wire drive circuit, without the input voltage holder 21 being provided. For the supplemental charging, for example, following each line return the print wire drive circuit need only be driven at a pulse having as high a frequency as the one used for the initial charging (only a few driving operations are required, compared with the number that is needed for the initial charging).

Figure 6:
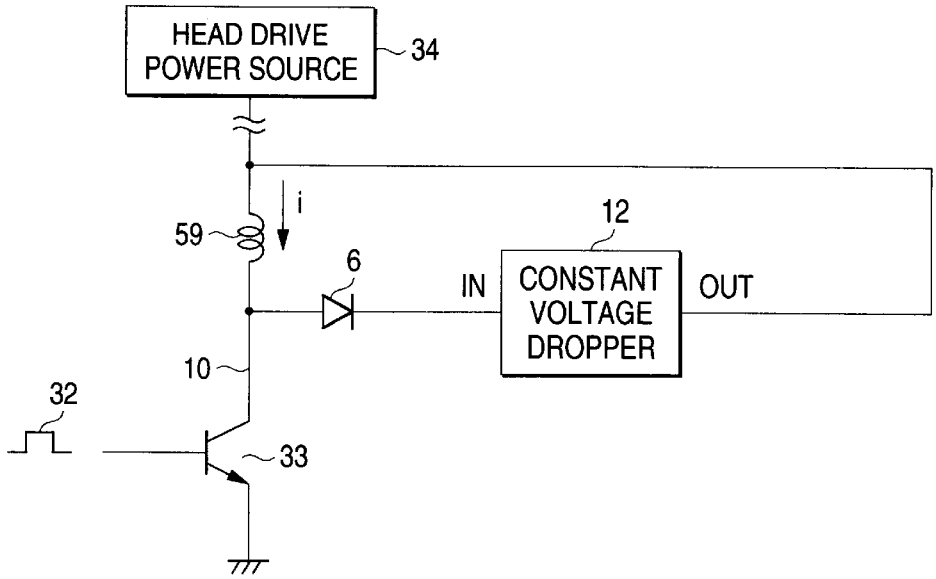
FIG. 6 is a diagram showing the arrangement of a head driving circuit according to one embodiment of the invention.

A third embodiment of the present invention will now be described while referring to the drawings. FIG. 6 is a diagram showing the arrangement of a head drive circuit according to a third embodiment of the present invention. The head drive circuit differs from the circuit for the first embodiment shown in FIG. 6, in that the constant voltage-input DC/DC converter 2 and the initial voltage charger 4 are replaced with a constant voltage dropper 12.

As is shown in FIG. 6, the head driving circuit comprises: a head driver transistor 33, for driving a head coil 59; a constant voltage dropper 12, which reduces, to a predetermined voltage value, an induction voltage that is generated at the head coil 59 when the head driver transistor 33 is turned off and which returns the obtained voltage to a head driving power source 34; and a diode 6, the anode of which is connected to the head coil 59 and a collector 10 of the head driver transistor 33 and the cathode of which is connected to the input end of the constant voltage dropper 12.

Figure 7:
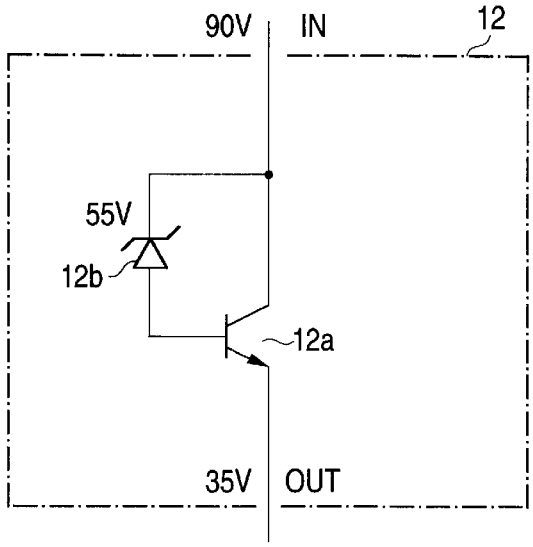
FIG. 7 is a circuit diagram showing a constant voltage drop circuit according to the embodiment.
Figure 8:
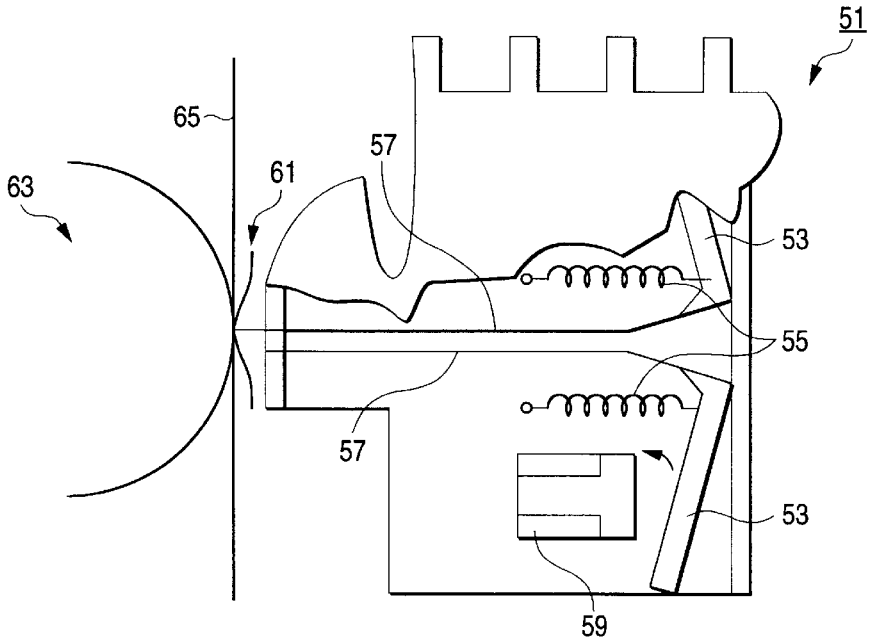
FIG. 8 is a diagram showing an example wire impact print head for the print head of an impact dot printer.
Figure 9:
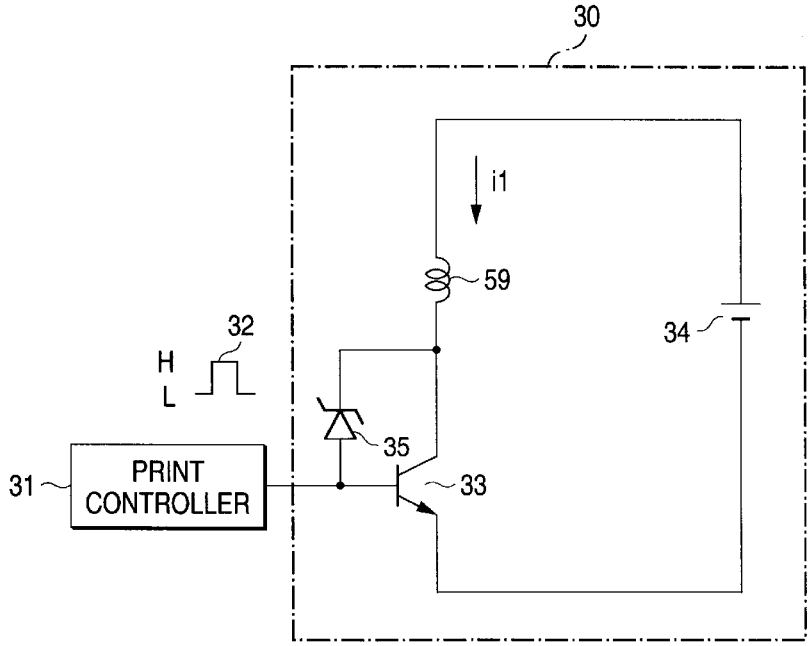
FIG. 9 is a diagram showing an example arrangement of a related head drive circuit.
Figure 10A:
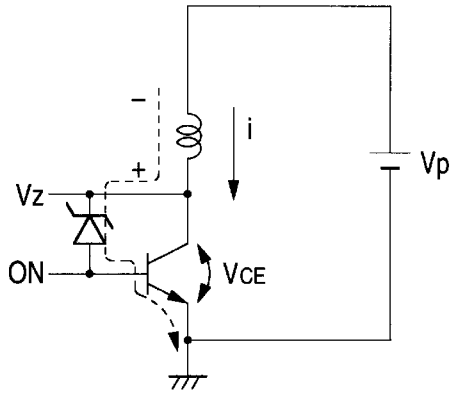
FIGS. 10A to 10D are diagrams for explaining the operation of the related head drive circuit, with FIG. 10A being a simplified circuit diagram for the related head drive circuit.
Figure 10B:
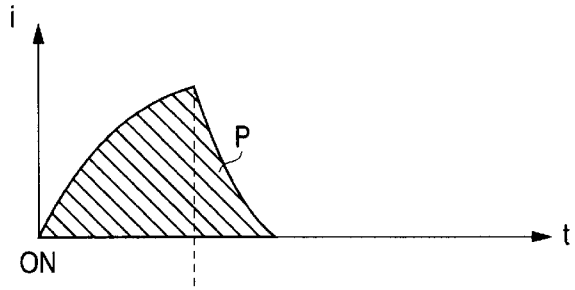
Figure 10C:
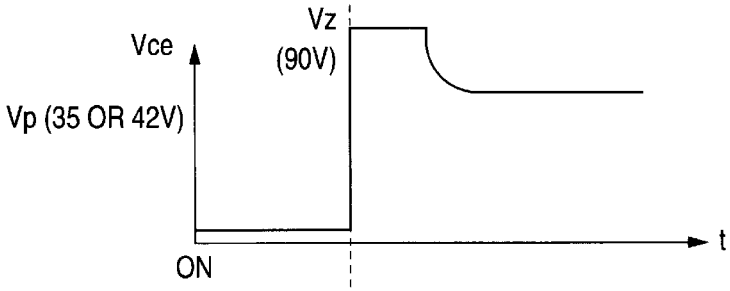
Figure 10D:
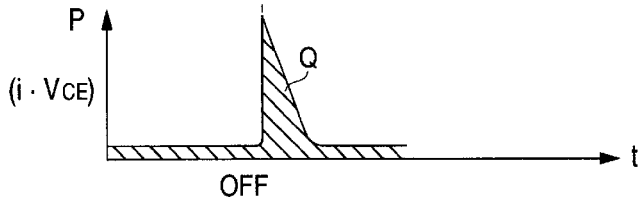

The arrangement of the constant voltage dropper 12 is shown in FIG. 7.

The constant voltage dropper 12 is constituted by a transistor 12*a* and a Zener diode 12*b*. The collector of the transistor 12*a* is connected to the cathode of the Zener diode 12*b*, the base of the transistor 12*a* is connected to the anode of the Zener diode 12*b*, and the emitter (the output end of the constant voltage dropper 12) of the transistor 12*a* is connected to the head driving power source 34. In this embodiment, the Zener voltage of the Zener diode 12*b* is 55V, and the voltage of the head driving power source 34 is 35V. That is, the constant voltage dropper 12 is so designed that a current flows through it when the input voltage is 90V.

Since the processing performed by the constant voltage dropper 12 is fundamentally the same as the constant voltage-input DC/DC converter 2 and the initial voltage charger 4 in the first embodiment, the detailed processing will be described below with reference to FIGS. 3A to 3D used for explaining the voltage absorption of the first embodiment.

While, as is indicated by a chained line in FIG. 3A, it is natural for a pair of the head coil 59 and the head driver transistor 33 to be provided for each of multiple print wires, the processing will be explained for the pair of the head coil 59 and the head driver transistor 33 for one print wire. First, when the head driver transistor 33 is rendered on, the drive current i, which is supplied by the power source Vp in the direction indicated by an arrow, drives the head coil 59.

When the head driver transistor 33 is turned off, the induced electromotive force having the polarities shown in FIG. 3A is generated at the head coil 59 and a high induction voltage is produced. When the induction voltage is 90V, the driver current i flows via the diode 6 to the constant voltage dropper 12, as indicated by an arrow in FIG. 3A. In this manner, power that was supplied to the head coils 59 of multiple print wires when they were turned off is absorbed by the constant voltage dropper 12. The power absorbed by the constant voltage dropper 12 is returned, via the Zener diode 12*b* (for which the Zener voltage is 55V), from the output end of the; constant voltage dropper 12 to the head driving power source 34. More specifically, when a voltage of 90V is applied to the input end of the constant voltage dropper 12, the voltage is reduced 55V by the Zener diode 12*b*, and 35V is output by the constant voltage dropper 12 and is returned for reusable power to the head driving power source 34.

The above process will now be explained while referring to FIGS. 3B to 3D.

First, when the head driver transistor 33 is turned on, the drive current i flows from the head driving power source 34, and the power P shown in FIG. 3B is supplied to and drives the head coil 59. Then, when the head driver transistor 33 is turned off, an induced electromotive force having the polarities shown in FIG. 3A is produced at the head coil 59, the collector voltage of the head transistor 33 is raised as is shown in FIG. 3C, and power P1 (right-down hatched portion in FIG. 3B) is supplied from the head coil 59 to the constant voltage dropper 12. The power that is obtained by subtracting, from the power P1, the power that is consumed by the constant voltage drop circuit 55 to reduce the voltage 55V is returned to the head driving power source 34. Therefore, since the head driver transistor 33 can be immediately and completely rendered off, and since the current that flows through the head driver transistor 33 is substantially zero, there is no substantial power loss at the head driver transistor 33, as is shown in FIG. 3D. That is, as is indicated in the right-down hatched portion in FIG. 3B, in this embodiment the power P1 that is to be wasted in the related art, when the head driver transistor 33 is rendered off, can be returned to the power source 34, and can be used again as head driving energy. The heat generated by the transistor 33 is also considerably reduced, so that only a simple cooling countermeasure is required, and the size of the package of a power source can be reduced.

In FIG. 3, the ratio of the power P1 (the right-down hatched portion in FIG. 3B) in the OFF state to the total power P (the left-down hatched portion in FIG. 3B) that flows through the head coil 59, i.e., P1/P, is normally 0.15 to 0.20 (15 to 20%). The ratio of the power consumed by the constant voltage dropper 12 to the power P1 when the head transistor 33 is turned off is (55V/90V)×100≅60%. Therefore, when the head transistor 33 is turned off approximately 40% of the power P1 is returned to the head driving power source 34 and is effectively utilized. Thus, the increased power efficiency that the constant voltage dropper 12 makes available can be obtained as follows.

Assume that P denotes the total power P that flows through the head coil 59, P1 denotes the power that flows through the head coil 59 when the head driver transistor 33 is turned off, $E_{in}$ denotes the input voltage for the constant voltage dropper 12 when the head driver transistor 33 is turned off, and $E_{out}$ denotes the reduced voltage that is produced by the constant voltage dropper 12 and returned to the head driving power source 34. Then, the improved power efficiency η that is provided by the constant voltage dropper 12 is represented as follows.

$$\eta=(P1/P)\times(E_{out}/E_{in})\times 100\% \quad (1)$$

Assume that the ratio (P1/P) of the power P1 in the OFF state to the total power P is 0.15, that the input voltage ($E_{in}$) of the constant voltage dropper 12 in the OFF state is 90V, and that the voltage of 90V is reduced 55V by the constant voltage dropper 12, and the remaining voltage of 35V (actually the power that corresponds to 35V) is returned to the head driving power source 34. According to equation (1), the power efficiency is 0.15×(35/90)×100≅6%, and the power efficiency, in other words, can be increased about 6%.

As is described above, according to this embodiment, the power that is accumulated at the head coil 59 when the head driver transistor 33 is turned on is partially consumed by the constant voltage dropper 12 when the transistor 33 is turned off, and the remaining power is returned to the head driving power source 34. Therefore, since the power accumulated at the head coil 59 is not lost due to heat generation at the head driver transistor 33, a part of this power can be effectively used again as energy for driving the head coil. Thus, the efficiency of the head driving power source can be improved.

Further, since heat generated by the head driver transistor 33 is also drastically reduced by this method, only a simple heat sink is required for the transistor 33, and the power source package can be compactly made. Furthermore, since the consumption of power by the head driver transistor 33 can also be reduced, the head can be efficiently driven, and as a result, the entire power supply apparatus can be made compactly, Explanations have been given for three embodiments of the invention, but these embodiments are merely examples; the invention is not limited to the above and various other embodiments can be employed for its implementation.

What is claimed is:

1. A head drive circuit for an impact dot printer which performs printing by driving a print wire, comprising:

a DC power source for supplying a power source voltage;

a head coil;

a switching element which is on/off controlled to apply the power source voltage to the head coil for a predetermined time period;

a voltage regulator for converting an input voltage having a value higher than the power source voltage into an output voltage having a value as substantially same as the power source voltage;

a voltage introducer for inputting an inductive voltage, generated in the head coil when the switching element is turned off, into the voltage regulator as the input voltage;

a voltage returner for feeding back the output voltage of the voltage regulator to the DC power source; and an input voltage adjuster for adjusting the input voltage of the voltage regulator so as to have a predetermined value higher than the power source voltage.

2. The head drive circuit as set forth in claim 1, wherein a DC/DC converter serves as the voltage regulator.

3. The head drive circuit as set forth in claim 1, wherein a voltage dropper serves as the voltage regulator.

4. The head drive circuit as set forth in claim 1, wherein the voltage introducer includes a first rectifier which is rendered conductive when inductive voltage is generated in the head coil to unidirectionally supply current into the input of the voltage regulator; and wherein the voltage returner includes a second rectifier for unidirectionally supplying the output voltage from the voltage regulator to the DC power source.

5. The head drive circuit as set forth in claim 1, wherein the voltage regulator includes an input condenser for smoothing the input voltage thereof; and wherein the voltage adjuster includes a charger for charging the input condenser so as to have the predetermined value of input voltage before and while the printing is performed.

6. The head drive circuit as set forth in claim 5, wherein the charger always applies the predetermined value of voltage to the input condenser.

7. The head drive circuit as set forth in claim 5, wherein the charger includes an initial charger for charging the input condenser so as to have the predetermined value of input voltage before the printing is performed, and an input voltage holder for holding the charged voltage at the predetermined value while the printing is performed.

8. The head driver as set forth in claim 5, wherein the switching element is turned on/off repeatedly at a frequency higher than a maximum frequency to drive the print wire to apply the inductive voltage to the input condenser repeatedly at least before the printing is performed, thereby the switching element and the head coil serve as the charger.

9. The head drive circuit as set forth in claim 5, wherein the charger includes:

a charge coil;

a coil switching element which is on/off controlled to apply the power source voltage to the charge coil; and a voltage introducer for inputting an inductive voltage, generated in the charge coil when the switching element is turned off, to the input condenser; and wherein the coil switching element is turned on/off repeatedly to apply the inductive voltage generated in the charge coil to the input condenser repeatedly at least while the printing is performed, thereby the charged voltage in the input condenser is maintained at the predetermined value.

10. The head drive circuit as set forth in claim 3, wherein the voltage dropper includes a transistor in which a collector is used as an input terminal and an emitter is used as an output terminal, and a Zener diode connected between a base and the collector of the transistor to determine a dropped voltage value.

11. A head drive circuit for an impact dot printer which performs printing by driving a print wire, comprising:

a DC power source for supplying a power source voltage;

a head coil;

a switching element which is on/off controlled to apply the power source voltage to the head coil for a predetermined time period;

a DC/DC converter for converting an input voltage having a value higher than the power source voltage into an output voltage having a value as substantially the same as the power source voltage;

a voltage introducer for inputting an inductive voltage, generated in the head coil when the switching element is turned off, into the DC/DC converter as the input voltage;

a voltage returner for feeding back the output voltage of the DC/DC converter to the DC power source; and an input voltage adjuster for adjusting the input voltage of the DC/DC converter so as to have a predetermined value higher than the power source voltage.

12. A head drive circuit for an impact dot printer which performs printing by driving a print wire, comprising:

a DC power source for supplying a power source voltage;

a head coil;

a switching element which is on/off controlled to apply the power source voltage to the head coil for a predetermined time period;

a voltage regulator for converting an input voltage having a value higher than the power source voltage into an output voltage having a value as substantially the same as the power source voltage;

a voltage introducer for inputting an inductive voltage, generated in the head coil when the switching element is turned off, into the voltage regulator as the input voltage;

a voltage returner for feeding back the output voltage of the voltage regulator to the DC power source; and an input voltage adjuster for adjusting the input voltage of the voltage regulator so as to have a predetermined value higher than the power source voltage;

wherein the voltage regulator includes an input condenser for smoothing the input voltage thereof; and wherein the voltage adjuster includes a charger for charging the input condenser so as to have the predetermined value of input voltage.

* * * * *